US008475675B2

(12) United States Patent
Diener et al.

(10) Patent No.: US 8,475,675 B2
(45) Date of Patent: Jul. 2, 2013

(54) POLYMER DISPERSIONS FOR FIRE PREVENTION AND FIREFIGHTING

(75) Inventors: Bernd Diener, Krefeld (DE); Veronika Gehler, Krefeld (DE); Erich Kuester, Krefeld (DE); Daniel Roulands, Krefeld (DE); Dieter Wehrhahn, Willich (DE)

(73) Assignee: Evonik Degussa GmbH, Essen (DE)

( * ) Notice: Subject to any disclaimer, the term of this patent is extended or adjusted under 35 U.S.C. 154(b) by 85 days.

(21) Appl. No.: 12/046,574

(22) Filed: Mar. 12, 2008

(65) Prior Publication Data

US 2008/0185160 A1 Aug. 7, 2008

Related U.S. Application Data

(60) Division of application No. 10/377,980, filed on Feb. 27, 2003, now abandoned, which is a continuation of application No. PCT/EP01/09057, filed on Aug. 6, 2001.

(30) Foreign Application Priority Data

Aug. 23, 2000 (DE) ..... 100 41 395

(51) Int. Cl.
*A62D 1/00* (2006.01)

(52) U.S. Cl.
USPC ..... 252/2; 169/43; 169/45; 169/46

(58) Field of Classification Search
USPC ..... 252/2; 169/43, 45, 46
See application file for complete search history.

(56) References Cited

U.S. PATENT DOCUMENTS

| | | | | |
|---|---|---|---|---|
| 3,354,084 | A | | 11/1967 | Katzer |
| 3,728,258 | A | | 4/1973 | Livingston |
| 3,758,641 | A | | 9/1973 | Zweigle |
| 4,089,831 | A | | 5/1978 | Chambers |
| 4,384,988 | A | | 5/1983 | Schoenholz et al. |
| 4,522,968 | A | | 6/1985 | Horacek |
| 4,610,311 | A | | 9/1986 | Bronner et al. |
| 4,624,320 | A | | 11/1986 | Romaine |
| 4,799,962 | A | | 1/1989 | Ahmed |
| 4,929,717 | A | | 5/1990 | Chmelir |
| 4,942,189 | A | | 7/1990 | Peiffer et al. |
| 4,978,460 | A | | 12/1990 | Von Blucher et al. |
| 4,990,608 | A | | 2/1991 | Zapico |
| 5,001,231 | A | | 3/1991 | Zapico |
| 5,114,484 | A | | 5/1992 | Lynch |
| 5,114,485 | A | | 5/1992 | Lynch et al. |
| 5,126,390 | A | | 6/1992 | Duff |
| 5,190,110 | A | | 3/1993 | Von Blucher et al. |
| 5,199,980 | A | | 4/1993 | Lynch et al. |
| 5,258,069 | A | | 11/1993 | Knechtel et al. |
| 5,264,251 | A | * | 11/1993 | Geursen et al. ..... 427/389.9 |
| 5,314,535 | A | | 5/1994 | Lynch et al. |
| 5,318,619 | A | | 6/1994 | Lynch et al. |
| 5,334,243 | A | | 8/1994 | Hyman |
| 5,362,312 | A | | 11/1994 | Skaggs et al. |
| 5,437,719 | A | | 8/1995 | Lynch et al. |
| 5,480,480 | A | | 1/1996 | Lynch et al. |
| 5,487,777 | A | | 1/1996 | Lundan et al. |
| 5,504,123 | A | | 4/1996 | Partan, III |
| 5,583,214 | A | | 12/1996 | Partain, III |
| 5,696,228 | A | | 12/1997 | Coville |
| 5,785,747 | A | | 7/1998 | Vollmer et al. |
| 5,792,366 | A | | 8/1998 | Coville |
| 5,840,804 | A | | 11/1998 | Carl et al. |
| 5,843,320 | A | | 12/1998 | Huang et al. |
| 5,849,210 | A | | 12/1998 | Pascente et al. |
| 5,872,143 | A | | 2/1999 | Tanaka et al. |
| 5,908,886 | A | | 6/1999 | Uchida et al. |
| 5,919,854 | A | | 7/1999 | Huang et al. |
| 5,932,193 | A | | 8/1999 | Lopez et al. |
| 5,969,012 | A | | 10/1999 | Harris, Jr. |
| 5,985,801 | A | | 11/1999 | Hoff |
| 5,985,992 | A | | 11/1999 | Chen |
| 5,989,446 | A | | 11/1999 | Hicks et al. |
| 6,001,920 | A | | 12/1999 | Ghafoor et al. |
| 6,031,037 | A | | 2/2000 | Ghafoor et al. |
| 6,080,704 | A | | 6/2000 | Halliday et al. |
| 6,093,769 | A | | 7/2000 | Burdick et al. |
| 6,100,222 | A | | 8/2000 | Vollmer et al. |

(Continued)

FOREIGN PATENT DOCUMENTS

| | | | |
|---|---|---|---|
| DE | 2202505 | A | 8/1972 |
| DE | 2612846 | | 10/1976 |
| DE | 2647078 | A | 5/1977 |
| DE | 2924663 | | 12/1979 |
| DE | 3114630 | A1 | 4/1982 |
| DE | 3515865 | A1 | 11/1986 |
| DE | 3716304 | A | 11/1988 |
| DE | 37 24 709 | A1 | 2/1989 |
| DE | 3814751 | A1 | 11/1989 |
| DE | 196 37 908 | A | 3/1998 |
| DE | 197 41 188 | A1 | 3/1999 |
| DE | 29904848 | U | 6/1999 |
| DE | 198 39 199 | A1 | 3/2000 |
| EP | 0 228 397 | B1 | 6/1986 |

(Continued)

OTHER PUBLICATIONS

OECD Guideline 201 on "Alga, Growth Inhibition Test" adopted Jun. 7, 1984.

OECD Guideline 202, Part 1, 24H EC50 Acute Immobilisation Test of OECD Guideline 202 on "Daphnia sp., Acute Immobilisation Test and Reproduction Test" adopted Apr. 4, 1984.

*Primary Examiner* — Vickey Nerangis

(74) *Attorney, Agent, or Firm* — Clara R. Cottrell; David M. Krasnow; Smith Moore Leatherwood LLP

(57) ABSTRACT

The present invention relates to water-in-oil polymer dispersions comprising of a continuous organic phase and therein finely dispersed and cross-linked, water-swellable polymerizates, where these have a residual monomer content of less than 1,000 ppm. The present invention relates further to a process for the production of polymer dispersions according to the invention. In addition, the present invention relates to devices for fire prevention and firefighting and to the use of the polymer dispersions according to the invention.

16 Claims, No Drawings

U.S. PATENT DOCUMENTS

| | | | |
|---|---|---|---|
| 6,113,891 | A | 9/2000 | Burdick et al. |
| 6,174,950 | B1 | 1/2001 | Nzudie et al. |
| 6,209,655 | B1 | 4/2001 | Valkanas |
| 6,214,331 | B1 | 4/2001 | Vanderhoff et al. |
| 6,225,395 | B1 | 5/2001 | Nzudie et al. |
| 6,245,252 | B1 | 6/2001 | Hicks et al. |
| 6,262,168 | B1 | 7/2001 | Huang et al. |
| 6,372,901 | B1 | 4/2002 | Partain, III et al. |
| 6,372,902 | B1 | 4/2002 | Partain, III et al. |
| 6,433,056 | B1 | 8/2002 | Burdick et al. |
| 6,433,132 | B1 | 8/2002 | Wood et al. |
| 6,479,573 | B2 | 11/2002 | Burdick et al. |
| 6,489,270 | B1 | 12/2002 | Vollmer et al. |
| 6,514,418 | B1 | 2/2003 | Bartscherer et al. |
| 6,544,503 | B1 | 4/2003 | Vanderhoff et al. |
| 6,608,124 | B1 | 8/2003 | Huang et al. |
| 6,632,779 | B1 | 10/2003 | Vollmer et al. |
| 6,635,604 | B1 | 10/2003 | Halliday et al. |
| 6,641,624 | B1 | 11/2003 | Govoni et al. |
| 6,664,326 | B1 | 12/2003 | Huang et al. |
| 6,670,508 | B2 | 12/2003 | Riondel |
| 6,702,946 | B1 | 3/2004 | Huang et al. |
| 6,712,897 | B2 | 3/2004 | Ayambem et al. |
| 6,750,276 | B2 | 6/2004 | Ruggiero et al. |
| 6,818,597 | B2 | 11/2004 | Harris |
| 6,936,278 | B2 | 8/2005 | Reslow et al. |
| 6,962,953 | B2 | 11/2005 | Probst et al. |
| 6,964,691 | B1 | 11/2005 | Govoni et al. |
| 2002/0193545 | A1 | 12/2002 | Riondel |
| 2003/0031774 | A1 | 2/2003 | Frith et al. |
| 2003/0180371 | A1 | 9/2003 | Reslow et al. |
| 2004/0006175 | A1 | 1/2004 | Diener et al. |
| 2004/0034145 | A1 | 2/2004 | Fischer et al. |
| 2004/0046158 | A1 | 3/2004 | Hubner |
| 2004/0090625 | A1 | 5/2004 | Fischer et al. |
| 2004/0131521 | A1 | 7/2004 | Kuboth |
| 2004/0211932 | A1 | 10/2004 | Houben et al. |
| 2004/0225051 | A1 | 11/2004 | Moy |
| 2004/0258753 | A1 | 12/2004 | Demeester et al. |
| 2005/0039253 | A1 | 2/2005 | Yang et al. |
| 2005/0084469 | A1 | 4/2005 | Wood et al. |
| 2005/0238716 | A1 | 10/2005 | Verrijk et al. |
| 2005/0242045 | A1 | 11/2005 | Steiner et al. |

FOREIGN PATENT DOCUMENTS

| | | | |
|---|---|---|---|
| EP | 664302 | B1 | 1/1995 |
| EP | 670333 | B1 | 2/1995 |
| EP | 0649669 | A | 4/1995 |
| EP | 761701 | B1 | 8/1996 |
| EP | 0 774 279 | B1 | 1/2000 |
| PL | 362248 | | 10/2004 |
| RU | 2224160 | | 2/2004 |
| WO | 9219688 | | 11/1992 |
| WO | 9319135 | | 9/1993 |
| WO | 9422964 | | 10/1994 |
| WO | 9803228 | A | 1/1998 |
| WO | 9950308 | | 10/1999 |
| WO | 0012178 | | 3/2000 |
| WO | 0215983 | | 2/2002 |
| WO | 2005074869 | | 8/2005 |
| WO | 2005092954 | | 10/2005 |
| WO | 2005100415 | | 10/2005 |

* cited by examiner

POLYMER DISPERSIONS FOR FIRE PREVENTION AND FIREFIGHTING

This application is a divisional of U.S. application Ser. No. 10/377,980 filed Feb. 27, 2003, now abandoned, which was a continuation of International Application No. PCT/EP2001/009057 filed Aug. 6, 2001, which claims the benefit of German Application No. DE 100 41 395 filed Aug. 23, 2000.

FIELD OF INVENTION

The present invention relates to water-in-oil polymer dispersions, comprising a continuous organic phase and therein finely dispersed and cross-linked, water-swellable polymerizates, where these have a residual monomer content of less than 1,000 ppm. The present invention relates further to a process for the production of polymer dispersions according to the invention. In addition, the present invention relates to devices for fire prevention and firefighting and to the use of the polymer dispersions according to the invention.

BACKGROUND OF THE INVENTION

For effective fire prevention and fire fighting, additives with thickening properties are used to increase the viscosity of the firefighting water, in order to achieve, in comparison to water, an improved adhesion of the fire-extinguishing agent to surfaces, in particular to sloped surfaces. The majority of the known firefighting water additives include water-swellable polymers, which nevertheless are restricted in their applicability because of their solid, granular structure.

In order to overcome this disadvantage, polymer dispersions in the form of water-in-oil emulsions have been used recently, as described in EP 0 774 279 B1. These emulsions include a continuous oil phase, in which particles of a cross-linked, water-swellable polymer are dispersed. The polymer particles have particle sizes of less than 2 μm, whereby extremely short swelling times of less than 3 seconds result. Along with their high water absorption capacity the water-in-oil emulsions have the properties of a thickening agent so that after their mixing with water a highly viscous fire-extinguishing agent or fire-preventing agent is obtained which adheres well to any type of surface, in particular to sloped surfaces.

Disadvantageous in all the additives to firefighting water is their comparatively low environmental compatibility, in particular their toxic action with respect to microorganisms such as algae and daphnia. As a measure for the toxicity of a substance with respect to algae, $EC_{50}$ values are used which are determined according to the OECD Guideline 201, and, as a measure for the toxicity of a substance with respect to daphnia, corresponding $EC_{50}$ values are used which are determined according to the OECD Guideline 202, Part 1. Due to their toxicity with respect to algae or daphnia, the known firefighting water additives are classified according to European law as "environmentally hazardous" and must be designated with the hazard symbol "N". The use of firefighting water additives according to the state of the art is thus, from ecological points of view, above all questionable when they are to be used in the wild, therefore away from places which are equipped with a water system or water retention basins, such as, for example, in forest fires or bush fires.

An objective of the present invention is thus to provide environmentally compatible polymer dispersions which can be used as additives to firefighting water.

SUMMARY OF THE INVENTION

The objective is realized according to the invention by the preparation of water-in-oil polymer dispersion which includes a continuous organic phase practically not miscible with water and therein finely dispersed and cross-linked, water-swellable polymerizates and, in given cases, auxiliary substances where the water-in-oil polymer dispersions have a residual monomer content of less than 1,000 ppm.

DESCRIPTION OF THE PREFERRED EMBODIMENTS

A water-in-oil polymer dispersion comprises a polymer emulsion as well as a polymer suspension such as are described, for example, in Ullmann's Encyclopedia of Industrial Chemistry, 1988, Vol. A11, Page 254, which is hereby incorporated by reference and are thus considered as part of the disclosure.

By residual monomers in the sense of the present invention are meant the monomers used in a polymerization reaction and not converted during the polymerization, said monomers thus being chemically unchanged in the polymer dispersion after the polymerization.

The polymerizates contained in the water-in-oil polymer dispersions according to the invention are a class of products, which preferably are produced by inverse phase emulsion polymerization. In this process finely dispersed, cross-linked, water-swellable polymerizates are produced, with the addition of water-in-oil emulsifier, in a continuous organic phase practically not miscible with water.

For the production of the polymerizates, the monomers are added to the organic phase as a monomer solution comprising of suitable monomers and preferably at least one bifunctional cross-linking agent. According to the invention the monomer solution contains at least one polymerizable, hydrophilic monomer. It can however include a mixture of two or more monomers from the group of the hydrophilic monomers.

Hydrophilic monomers are, for example, substances, which include

- olefinically unsaturated carboxylic acids and carboxylic acid anhydrides, in particular acrylic acid, methacrylic acid, itaconic acid, crotonic acid, glutaconic acid, maleic acid, and maleic acid anhydride and their water-soluble salts,
- olefinically unsaturated sulfonic acids, in particular aliphatic or aromatic vinyl sulfonic acids such as, say, vinyl sulfonic acid, allyl sulfonic acid, styrene sulfonic acid, in particular acryl and methacryl sulfonic acids such as, say, sulfoethylacrylate, sulfoethylmethacrylate, sulfopropylacrylate, sulfopropylmethacrylate, 2-hydroxy-3-methacryloxypropyl sulfonic acid, and 2-acrylamido-2-methylpropane sulfonic acid (AMPS) and its water-soluble salts, and
- water-soluble or water-dispersible derivatives of acrylic and methacrylic acids, in particular acrylamide, methacrylamide, n-alkyl-substituted acrylamides, 2-hydroxyethylacrylate, 2-hydroxyethylmethacrylate, hydroxypropylacrylate, hydroxypropylmethacrylate, a $C_1$-$C_4$-alkyl(meth)acrylate, and vinyl acetate.

The monomer solution preferably contains, as monomers, acrylic acid and/or an acrylic acid derivative, particularly preferably at least one salt of acrylic acid and acrylamide, and quite particularly preferably a mixture of acrylic acid, acrylamide, and a salt of 2-acrylamido-2-methylpropane sulfonic acid. Along with one or more hydrophilic monomers, the monomer solution preferably contains in addition 0.1% by weight to 1% by weight of a bifunctional cross-linking agent.

The degree of cross-linking of the polymers quite significantly influences the viscosity, and thus the adhesive properties, of the resulting polymer. Preferably used as cross-linking agents are methylene bisacrylamide, allyl(meth)acrylate, diallylphthalate, polyethylene glycol di(meth)acrylate, tetraethylene glycol di(meth)acrylate, triethylene glycol di(meth) acrylate, diethylene glycol di(meth)acrylate, glycerin di(meth)acrylate, hydroxypropyl(meth)acrylate, or trimethylolpropane tri(meth)acrylate. Particularly preferably used as cross-linking agent is triallyl methyl ammonia chloride.

For the preparation of the polymerization and the production of the monomer-containing water-in-oil dispersion, the monomer solution is added to an organic phase, which contains a water-in-oil emulsifier.

As organic phase, it is possible to use all the substances known, to those skilled in the art, for inverse phase polymerization.

In a preferred form of embodiment of this invention, fatty acid esters are used as organic phase. Particularly preferably used are esters of linear saturated or unsaturated fatty acids, in particular fatty acids with an alkyl chain length of more than 11 carbon atoms, particularly preferably lauric, myristic, palmitic, stearic, or oleic acid with alcohols. Preferably used as alcohol components are short-chain alcohols, preferably $C_1$-$C_4$-alcohols. Also preferably used are higher, single-branched alcohols which preferably are produced by a Guerbet synthesis. Through the use of these substances, water-in-oil polymer dispersions are obtained which have a very low daphnia toxicity measured according to OECD Guideline 202. In particular, by use of the preferred organic phases, water-in-oil polymer dispersions are obtained which have an $EC_{50}$ value, determined according to OECD Guideline 202, of more than 10 mg/l.

The fatty acid esters are used alone or preferably in a mixture with a hydrocarbon or a mixture of hydrocarbons, where the hydrocarbon or the mixture of hydrocarbons has a boiling point of less than 200° C. Quite particularly preferred for this purpose are so-called white oils from petroleum distillation or ligroin with a boiling range of 150°-200° C.

Preferably the organic phase is used in an amount from 20% by weight to 80% by weight relative to the amount of the dispersion.

As emulsifier, 0.5% by weight to 10% by weight, relative to the amount of the dispersion, of an oil-soluble emulsifier is added to the organic phase. Preferably used are emulsifiers from the group of surfactants. Preferably used are sorbitan esters, phthalic acid esters, fatty acid glycerides, and ethoxylated derivatives of the same. Quite particularly preferably used are polymeric emulsifiers with the trade name HYPERMER® (from ICI, London England).

After conclusion of the polymerization a residual monomer eliminator is preferably added to the polymer dispersion. The addition measured so that the content of residual monomer in the resulting water-in-oil dispersion is less than 1,000 ppm.

Residual monomer eliminators in the sense of the present invention are substances, which modify the polymerizable monomers through a chemical reaction in such a manner that they are no longer polymerizable so that they are no longer monomers in the sense of the present invention. For this purpose, substances can be used which react with the double bond contained in the monomers and/or substances which can initiate a further polymerization.

As residual monomer eliminators, which react with the double bond, for example, reducing agents can be used, preferably

- substances from the group of acid or neutral salts of the acids derived from sulfur with an oxidation number less than VI, preferably sodium dithionite, sodium thiosulfate, sodium sulfite, or sodium disulfite, and/or
- substances with a hydrogen sulfide group, preferably sodium hydrogen sulfide or compounds from the groups of thiols, preferably mercaptoethanol, dodecylmercaptan, thiopropionic acid or salts of thiopropionic acid or thiopropane sulfonic acid or salts of thiopropane sulfonic acid, and/or
- substances from the group of amines, preferably from the group of amines with low volatility, preferably diisopropanolamine or aminoethylethanolamine, and/or
- substances from the group which include Bunte salts, formamidine sulphinic acid, sulfur dioxide, aqueous and organic solutions of sulfur dioxide or thiourea.

Those skilled in the art will recognize that a mixture of at least two residual monomers from one or more groups can also be used.

For the reduction of the residual monomer content through a newly initiated polymerization it is possible to use the aforementioned reducing agents in combination with oxidizing agents, preferably substances from the group of peroxodisulfates or hydroperoxides, preferably hydrogen peroxide. Furthermore, suitable for the reduction of the residual monomer content are compounds, which decompose at high temperatures into radicals, such as preferably substances from the group of azocompounds, peroxides, or peroxodisulfates.

Amounts of residual monomer eliminator relative to the dispersion include 100 ppm to 20,000 ppm, preferably 200 ppm to 5,000 ppm, and particularly preferably 500 to 3,000 ppm of residual monomer eliminator relative to the dispersion.

Subsequently an oil-in-water emulsifier, designated as activator or inverter, is added, in an amount of 0.5% by weight to 10% by weight relative to the amount of emulsion, to the water-in-oil polymer dispersion. Preferably ethoxylated fatty alcohols are used as inverter, preferably ethoxylated fatty alcohols which are produced from linear and/or branched fatty alcohols with an alkyl chain length of more than 11 carbon atoms. Also preferably used are ethoxylation products of highly branched alcohols, which can be obtained by oxo synthesis, such as, preferably, isotridecyl alcohol. Particularly preferably used, as inverter is an ethoxylation product of higher, single-branched alcohols, which can be obtained by Guerbet synthesis.

The water-in-oil polymer dispersion according to the invention contains preferably 10% by weight to 70% by weight, particularly preferably 20% by weight to 50% by weight, and quite particularly preferably 25% by weight to 35% by weight of cross-linked, water-swellable polymer particles.

The polymer particles have preferably a particle size of less than 2 μm, and particularly preferably a particle size of less than 1 μm. The swelling time of the polymer particles is preferably less than 3 seconds.

The water-in-oil polymer dispersions according to the invention and usable as a water additive for the prevention and fighting of fires are distinguished with respect to the previously known firefighting water additives by an improved environmental compatibility, in particular by a lower toxicity with respect to microorganisms. In particular they have, as determined according to the algae test according to the OECD Guideline 201, an $EC_{50}$ value of over 10 mg/l. In part, $EC_{50}$ values of over 10 mg/l are also obtained in the daphnia test according to the OECD Guideline 202 so that the dispersions according to the invention are classified according to European law merely as "damaging to water organisms". There is no requirement for designation with the hazard symbol "N".

Due to this improved environmental compatibility, the firefighting water additives according to the invention are, from ecological points of view, to be used preferentially over the state of the art in fire prevention and firefighting, above all in the wild and preferably in forest fires or bush fires.

An additional object of the present invention is a process for the production of the water-in-oil polymer dispersions according to the invention preferably by inverse phase emulsion polymerization where a residual monomer eliminator is added to the polymer dispersion after the polymerization.

For the production of the reaction solution the monomers are added to the organic phase as a monomer solution comprising of suitable monomers, water, and preferably at least one bifunctional cross-linking agent.

The polymerization reaction is started by addition of the polymerization initiators known to those skilled in the art. Preferably used in this connection are azocompounds, peroxide compounds, or redox catalysts, each alone or in a mixture with one another, in an amount of 0.001% by weight to 5% by weight relative to the amount of monomer solution.

The polymerization is carried out adiabatically, isothermally, or as a combination of an adiabatic and isothermal process.

In conducting the process isothermally according to EP 0 228 397 1 the polymerization is started at a certain temperature under reduced pressure. In so doing, the reduced pressure is set so that volatile substances, such as water and components of the organic phase, distill off due to the heat of polymerization and the temperature can be held constant to within several degrees. The end of the polymerization is characterized by the fact that no more distillate comes over. After the polymerization the aforementioned residual monomer eliminators are added to the polymer dispersion according to the invention. Since the dispersion is oxygen-free after the end of the reaction the reduction of the amount of residual monomers after addition of the residual monomer eliminators runs particularly effectively. 100 ppm to 20,000 ppm, preferably 200 ppm to 5,000 ppm, and particularly preferably 500 to 3,000 ppm of residual monomer eliminator relative to the dispersion are preferably added.

Analogous to the isothermal process, the adiabatic process is started at a certain temperature. However, the polymerization is carried out at atmospheric pressure without external supply of heat until a final temperature dependent on the content of polymerizable substance is achieved due to the heat of polymerization. After the end of the polymerization, cooling of the reaction mixture takes place. During the cooling, the residual monomer eliminator is added. Since in conducting the process in this manner no oxygen-free dispersions are obtained, greater amounts of residual monomer eliminator must be used. In conducting of the process in this manner, 100 ppm to 20,000 ppm, preferably 500 ppm to 5,000 ppm of residual monomer eliminator are preferably used.

The polymerization can furthermore be carried out as a combination of an isothermal and adiabatic process. Such a process is preferably first carried out isothermally. At a previously determined point in time the apparatus is aerated with an inert gas and the polymerization is carried on adiabatically up to a certain final temperature. Following this, the batch is cooled off by repeated application of vacuum and distillation up to a preselected temperature. By conducting the process in this manner an oxygen-free polymer dispersion is obtained so that the reduction of the amount of residual monomers runs particularly effectively after addition of the residual monomer eliminator.

100 ppm to 20,000 ppm, preferably 200 ppm to 5,000 ppm, and particularly preferably 500 to 3,000 ppm of residual monomer eliminator relative to the dispersion are preferably added.

Subsequently an oil-in-water emulsifier, designated as activator or inverter, is added, in an amount of 0.5% by weigh to 10% by weight relative to the amount of emulsion, to the water-in-oil polymer dispersion. Ethoxylated fatty alcohols are preferably used as inverter, preferably ethoxylated fatty alcohols which are produced from linear and/or branched fatty alcohols with an alkyl chain length of more than 11 carbon atoms. Also preferably used are ethoxylation products of highly branched alcohols, which can be obtained by oxo synthesis, such as, preferably, isotridecyl alcohol. Particularly preferably used, as inverter is an ethoxylation product of higher, single-branched alcohols, which can be obtained by Guerbet synthesis.

With the process according to the invention it is possible to produce polymer dispersions, which can be used as firefighting water and are more environmentally compatible than the processes according to the state of the art. Through the process according to the invention polymer dispersions are obtained which have $EC_{50}$ values of over 10 mg/l according to the algae test according to the OECD Guideline 201. In part, $EC_{50}$ values of over 10 mg/l are also obtained in the daphnia test according to the OECD Guideline 202 Part 1 so that the dispersion according to the invention are classified according to European law merely as "damaging to water organisms" and there is no requirement for designation with the hazard symbol "N".

Furthermore, the present invention relates to the use of the polymer dispersions according to the invention as fire-extinguishing agent in which the polymer dispersion is treated with water.

Fire-extinguishing agents in the sense of the present invention are agents, which are suitable to protect surfaces against fire and/or to fight fire.

The mixture of water-in-oil polymer dispersions according to the invention with water can take place in all devices customary for this purpose, such as, for example, are described in EP 0 774 279 B1 and in DE 299 04 848 U1. These documents are hereby incorporated by reference and are thus considered as part of the disclosure.

The polymer dispersions are preferably added to the water in a concentration of 0.01% by volume to 50% by volume. Particularly preferably 0.02% by volume to 10% by volume, and quite particularly preferably 1% by volume to 2% by volume of water-in-oil polymer dispersion is used for mixing with water.

In order to achieve a good adhesion of the fire-extinguishing agent to surfaces, the mixture of water and polymer dispersion preferably has a viscosity of over 100 mPas, particularly preferably a viscosity in the range of over 500 mPas to 5,000 mPas.

The use of the water-in-oil polymer dispersions according to the invention is distinguished with respect to the use of the known fire-extinguishing agents by a higher environmental compatibility, in particular by a lower toxicity with respect to microorganisms.

An additional object of the present invention is a process for the application of the water-in-oil polymer dispersions according to the invention to a surface for the prevention and/or fighting of fires, where water is treated with the polymer dispersion in an amount which is sufficient to raise the viscosity of the resulting water/polymer dispersion mixture to over 100 mPas and this mixture is applied to the surface.

In order to achieve this viscosity the polymer dispersion is mixed with water or aqueous extinguishing agents, preferably in a concentration of 0.01% by volume to 50% by volume, particularly preferably in a concentration of 0.02% by volume to 10% by volume, and quite particularly preferably in a concentration of 1% by volume to 2% by volume.

The fire-extinguishing agents according to this invention can be applied to the affected surfaces with any customary firefighting device. Such devices are, for example, described in EP 0 774 279 B1 and in DE 29 90 4848 U1.

The mixing of the polymer dispersions with water can preferably take place continuously or batch wise.

The process according to the invention is distinguished with respect to the known processes by an improved environmental compatibility. Thus, the process is particularly suitable to be used in the wild, therefore away from places, which are equipped with a water system or water retention basins, such as, for example, in forest or bush fires.

An additional object of the present invention is a device for fire prevention and for fire extinction, said device comprising of a pressure-resistant container for accommodating a polymer dispersion comprising of water and the polymer dispersion according to the invention.

The fire-extinguishing agent can be contained in the pressure-resistant container as a mixture of the polymer dispersion according to the invention and water and can be applied to the heart of the fire by customary discharge devices. However, the two components, namely the polymer dispersion and the water, are preferably initially housed separately from one another in different separate sections of the container and are mixed with one another by actuation of a triggering mechanism known for this purpose.

The device is preferably a manual fire-extinguisher or a fire-extinguisher train as described in the state of the art, preferably in EP 0 774 279 B1 and in DE 29 90 4848 U1.

The device according to the invention is distinguished by an increased environmental compatibility of the fire-extinguishing agent contained therein.

Test Methods

The determination of toxicity with respect to microorganisms was carried out in accordance with OECD "Guidelines for Testing of Chemicals".

In detail these are the OECD Guideline 201, "Alga, Growth Inhibition Test" and the OECD Guideline 202 Part 1, "Daphnia Acute Immobilisation Test".

EXAMPLES

In the following the invention is explained with the aid of examples. These explanations are merely exemplary and do not restrict the general concept of the invention.

Therein the following abbreviations are used:

ABAH 2,2'-azo-bis-amidinopropane-dihydrochloride
AIBN 2,2'-azo-bis-2-methylpropionitrile
AMPS 2-acrylamido-2-methylpropane sulfonic acid
BO 2-butyl-octanol
EO ethylene dioxide (1,2-epoxyethane)
IHD isohexadecane
ITDA isotridecylalcohol
ITS isotridecyl stearate
ÖFSBOE oil fatty acid butyloctylester
RÖFSME rape oil fatty acid methylester
TAMAC triallyl methyl ammonia chloride

Comparative Example 1

This product is marketed at present by the Stockhausen GmbH & Co. KG, Krefeld as an additive for firefighting water under the name FIRESORB® MF.

Initially an aqueous monomer solution is produced from the following components:

| | | |
|---|---|---|
| 457.0 | g | water |
| 84 | g | AMPS, sodium salt, 50% solution |
| 220 | g | acrylamide, 50% solution |
| 320 | g | acrylic acid |
| 320 | g | sodium hydroxide solution, 50% solution |
| 3.0 | g | formic acid, 85% |
| 1.0 | ml | VERSENEX ® 80 |
| 2.3 | g | TAMAC |
| 0.5 | g | ABAH |

Thereafter 30 g of HYPERMER® 1083 are dissolved in 180 g of RÖFSME and 300 g of isotridecyl stearate and the aqueous monomer solution is added with stirring. After the emulsion forms, it is homogenized with a high-speed household mixer and freed of dissolved oxygen by blowing with nitrogen. The polymerization is started at 20° C. by the addition of 2 ml of a 0.2% tert-butylhydroperoxide solution and 2.4 ml of sulfur dioxide gas, where the batch is heated by the arising heat of polymerization up to approximately 100° C. After cooling off, 80 g of isotridecylalcohol-6-ethoxylate is stirred in.

The results of the toxicity tests with respect to daphnia and algae are listed in Table 1.

Example 1 to 12

Comparative Examples 2 and 3

In these examples water-in-oil polymer dispersions are produced according to the polymerization processes (mode of operation) specified in Table 1, where "i" means isothermal and "a" means adiabatic. For the adiabatic or isothermal polymerization processes the formulations described in the following are used.

General formulation for the adiabatic polymerization (mode of operation "a").

Initially an aqueous monomer solution is produced from the following components:

| | | |
|---|---|---|
| 485.0 | g | water |
| 78 | g | AMPS, sodium salt, 50% solution |
| 203.5 | g | acrylamide, 50% solution |
| 297 | g | acrylic acid |
| 297 | g | sodium hydroxide solution, 50% solution |
| 3.0 | g | formic acid, 85% |
| 1.0 | ml | VERSENEX ® 80 |
| 2.3 | g | TAMAC |
| 0.5 | g | ABAH |

Thereafter, 30 g of HYPERMER® 1083 are dissolved in 480 g of organic phase and the aqueous monomer solution is added with stirring. After the emulsion forms, it is homogenized with a high-speed household mixer and freed of dissolved oxygen by blowing with nitrogen. The polymerization is started at 20° C. by the addition of 2 ml of a 0.2% tert-butylhydroperoxide solution and 2.4 ml sulfur dioxide gas, where the batch is heated by the arising heat of polymerization up to approximately 100° C. After reaching the peak temperature the polymer dispersion is cooled down by vacuum distillation up to approximately 40° C.

In the case of the examples according to the invention a 40 g secondary charge ($SO_2$ in Exxsol 100 or $Na_2SO_3$ solution)

is suctioned in under vacuum for residual monomer elimination and after the final cooling 4% activator is stirred in.

General Formulation for the Adiabatic Polymerization (Mode of Operation "i"1

Initially an aqueous monomer solution is produced from the following components:

| | | |
|---|---|---|
| 500.0 | g | water |
| 72.0 | g | AMPS, sodium salt, 50% solution |
| 186.0 | g | acrylamide, 50% solution |
| 272.0 | g | acrylic acid |
| 211.0 | g | sodium hydroxide solution, 50% solution |
| 3.0 | g | formic acid, 85% |
| 1.0 | ml | VERSENEX ® 80 |
| 2.5 | g | TAMAC |

Thereafter, 40 g of HYPERMER® 1083 are dissolved in 440 g of organic phase and the aqueous monomer solution is added with stirring. After the emulsion forms, it is homogenized with a high-speed household mixer and heated to 60° C. Thereafter, 0.3 g of AIBN is added and a vacuum is applied. Water is distilled off until the batch is free of oxygen and the polymerization has started. Due to the vacuum distillation, the reaction temperature remains constant within a range of 60° C.-65° C. After approximately 90 ml of water have been distilled the connection to the vacuum pump is closed and the apparatus aerated with nitrogen until normal pressure is reached. Due to the remaining heat of polymerization the batch is then heated up to approximately 90° C. After reaching the peak temperature the polymer dispersion is cooled down to approximately 40° C. by repeated vacuum distillation.

In the case of the examples according to the invention a 40 g secondary charge ($SO_2$ in Exxsol 100 or $Na_2SO_3$ solution) is suctioned in under vacuum for residual monomer elimination and after the final cooling 4% activator is stirred in.

The individual substances for the organic phase, the activator, the secondary charge and the results of the toxicity tests with respect to daphnia and algae are listed in Table 1.

What is claimed is:

1. A process for preventing fires or fighting fires, the process comprising:

providing a fire extinguishing agent; wherein the agent is made according to the process comprising treating water with an amount of a water-in-oil polymer dispersion sufficient to produce an agent having a viscosity of 100 mPas or more, wherein the water-in-oil dispersion comprises:

(i) a continuous organic phase immiscible with water; wherein said continuous organic phase comprises:

(A) a fatty acid ester or mixture of at least two fatty acid esters; and (B) white oils from petroleum distillation or ligroin;

wherein said white oils have a boiling range of 150° C. to 200° C.; and (ii) finely dispersed and cross-linked, water-swellable polymerizates;

wherein said polymerizates were produced via an inverse phase polymerization process; and wherein an amount of a residual monomer present in the water-in-oil dispersion is less than 1,000 ppm after a predetermined amount of a residual monomer eliminator is provided to the water-in-oil dispersion; and wherein the water-in-oil dispersion has an environmental compatibility measured by having an $EC_{50}$ value over about 10 mg/l according to OECD Guideline 201 and OECD Guideline 202; and applying the agent to a surface.

2. The process according to claim 1 wherein the agent comprises 0.01% by volume to 50% by volume of the water-in-oil polymer dispersion.

3. The process according to claim 1 wherein the treating water with an amount of a water-in-oil polymer dispersion comprises batchwise mixing the water-in-oil polymer dispersion with water.

4. The process according to claim 1 wherein the treating water with an amount of a water-in-oil polymer dispersion comprises continuously mixing the water-in-oil polymer dispersion with water.

TABLE 1

| Example | Mode of Operation | Organic Phase | Activator | Secondary charge | Acrylic acid [ppm] | Daphnia toxicity | Algae toxicity |
|---|---|---|---|---|---|---|---|
| Comparative Example 1 | a | RÖFSME/ITS 3:5 | ITDA-5EO | — | 2,000 | 3.4 | 5.5 |
| Comparative Example 2 | a | ITS | ITDA-5EO | — | 1,700 | 1.5 | 4.4 |
| Comparative Example 3 | i | RÖFSME/Shellsol D 40 18:7 | ITDA-5EO | — | 1,800 | 33 | 9.7 |
| 1 | a | RÖFSME/ITS 3:5 | ITDA-5EO | 2% $SO_2$ in Exxsol 100 | 160 | 2.1 | 74 |
| 2 | a | RÖFSME/ITS 3:5 | ITDA-5EO | 2% $Na_2SO_3$ solution | 260 | 1.5 | 62 |
| 3 | a | RÖFSME/IHD 18:7 | ITDA-5EO | 2% $Na_2SO_3$ solution | 340 | <1 | 37 |
| 4 | i | RÖFSME/Shellsol D 40 18:7 | ITDA-5EO | 5% $Na_2SO_3$ solution | 110 | 29 | 66 |
| 5 | a | RÖFSME/Shellsol D 40 5:1 | ITDA-5EO | 2% $Na_2SO_3$ solution | 510 | 47 | 29 |
| 6 | i | RÖFSME/Shellsol D 40 18:7 | ITDA-5EO | 2% $SO_2$ in Exxsol 100 | 360 | 37 | 37 |
| 7 | i | RÖFSME/Shellsol D 40 18:7 | BO-5EO | 2% $Na_2SO_3$ solution | 510 | 64 | 80 |
| 8 | i | RÖFSME/Shellsol D 40 18:7 | ITDA-5EO | 2% $Na_2SO_3$ solution | 730 | 36 | 18 |

5. The process according to claim 1 wherein the water-in-oil polymer dispersion comprises:

(a) 20% by weight to 80% by weight of the continuous organic phase;

(b) 10% by weight to 70% by weight of the finely dispersed and cross-linked, water-swellable polymerizate;

(c) 0.5% by weight to 10% by weight of the water-in-oil emulsifier;

(d) 0.1% by weight to 2% by weight of the residual monomer eliminator;

(e) 0.5% by weight to 10% by weight of an inverter;

(f) a residual monomer content of less than 1,000 ppm; and (g) a remainder to 100% by weight of water.

6. The process according to claim 5 wherein the residual monomer eliminator comprises any one of:

(i) a substance including an acid including a sulfur with an oxidation number less than VI;

(ii) a substance including a neutral salt of an acid including a sulfur with an oxidation number less than VI;

(iii) a substance including a hydrogen sulfide group;

(iv) a substance including an amine;

(v) a substance selected from the group consisting of a bunte salt, a formamidine sulphinic acid, a sulfur dioxide, an aqueous solution of sulfur dioxide, an organic solution of sulfur dioxide, and thiourea; or (vi) a mixture of any of two or more of the preceding.

7. The process according to claim 5, wherein the water-in-oil polymer dispersion comprises 20% by weight to 50% by weight of the finely dispersed and cross-linked, water-swellable polymerizate.

8. The process according to claim 1, wherein the fatty acid ester is selected from the group consisting of an ester of linear saturated fatty acids with an alkyl chain length of more than 11 carbon atoms and of $C_1$-$C_4$-alcohols or higher, single-branched alcohols; an ester of linear unsaturated fatty acids with an alkyl chain length of more than 11 carbon atoms and of $C_1$-$C_4$-alcohols or higher, single-branched alcohols; and a mixture of at least two of these esters.

9. The process according to claim 1, wherein the water-swellable polymerizate comprises an acrylic acid or an acrylic acid derivative.

10. The process according to claim 1, wherein the water-swellable polymerizate comprises a salt of acrylic acid and an acrylamide.

11. The process according to claim 1, wherein the water-swellable polymerizate comprises a salt of acrylic acid, an acrylamide, and a salt of 2-acrylamido-2-methylpropane sulfonic acid.

12. The process according to claim 1, comprising triallyl methyl ammonia chloride as a cross-linking agent.

13. The process according to claim 1, wherein the water-swellable polymerizate comprises polymer particles having a particle size of 2 μm or less.

14. The process according to claim 1, wherein the water-swellable polymerizate comprises polymer particles and wherein a swelling time of the polymer particles is 3 seconds or less.

15. The process according to claim 1, wherein treating water with an amount of water-in-oil polymer dispersion is sufficient to produce a mixture having a viscosity of greater than 500 mPas to 5000 mPas.

16. A method for using an agent for fire protection and/or fire fighting, the method comprising:

(a) providing an agent comprising a water-in-oil polymer dispersion mixture comprising:

(i) a continuous organic phase immiscible with water; wherein said continuous organic phase comprises (A) a fatty acid ester or mixture of at least two fatty acid esters; and (B) white oils from petroleum distillation or ligroin;

wherein said white oils have a boiling range of 150° C. to 200° C.;

(ii) finely dispersed and cross-linked, water-swellable polymerizates; and (iii) a residual monomer content of less than 1,000 ppm; wherein after the inverse phase polymerization of an emulsion to produce the cross-linked, water-swellable polymerizates, a sufficient amount of a residual monomer eliminator selected from the group consisting of:

(A) acid or neutral salts derived from sulfur with an oxidation number less than VI;

(B) sodium dithionite;

(C) sodium thiosulfate;

(D) sodium sulfite or sodium disulfite;

(E) substances with a hydrogen sulfide group;

(F) sodium hydrogen sulfide; or (G) compounds from the groups of:

(1) thiols, (2) mercaptoethanol, (3) dodecylmercaptan, (4) thiopropionic acid, (5) salts of thiopropionic acid, (6) salts of thiopropane sulfonic acid, or (7) salts of amines is communicated with the resulting water-in-oil polymer dispersion to reduce the residual monomer content to less than about 1,000 ppm;

(b) treating water with an amount of the agent sufficient to raise the viscosity of the resulting mixture to 100 mPas or more to produce a fire extinguishing agent having an environmental compatibility measured by having an $EC_{50}$ value over about 10 mg/l according to OECD Guideline 201 and OECD Guideline 202; and (c) applying said fire extinguishing agent to a surface.

* * * * *